United States Patent [19]

Noll et al.

[11] Patent Number: 4,938,802

[45] Date of Patent: Jul. 3, 1990

[54] REUSABLE CERAMIC MOLD

[75] Inventors: Dale A. Noll, Corning; John J. Scholl, Elmira; Stephen G. Skellett, II, Corning, all of N.Y.

[73] Assignee: Corning Incorporated, Corning, N.Y.

[21] Appl. No.: 300,289

[22] Filed: Jan. 19, 1989

[51] Int. Cl.[5] ..... B22C 1/00

[52] U.S. Cl. ..... 106/38.9; 106/38.2; 164/529; 164/364

[58] Field of Search ..... 164/271, 349, 358, 361, 164/364, 365, 368, 339, 340, 27, 28, 29, 132, 529; 106/38.2, 38.9

[56] References Cited

U.S. PATENT DOCUMENTS

| | | | |
|---|---|---|---|
| 2,368,718 | 2/1945 | Miller | 164/28 |
| 3,508,601 | 4/1970 | McArdle | 164/358 |
| 3,598,732 | 8/1971 | Foster et al. | 164/358 |
| 3,720,397 | 3/1973 | Voegele | 164/340 |
| 4,008,748 | 2/1977 | Gunnergaard | 164/340 |
| 4,244,551 | 7/1981 | Terkelsen et al. | 106/38.9 |
| 4,411,305 | 10/1983 | Beetle | 164/529 |
| 4,757,857 | 7/1988 | Henkel | 164/364 |

*Primary Examiner*—Richard K. Seidel

*Attorney, Agent, or Firm*—Thomas J. Greer, Jr.; Richard N. Wardell

[57] ABSTRACT

A metal casting mold formed of a ceramic material. The mold is reusable and is formed of a crystalline ceramic whose coefficient of thermal expansion (in the range 0° to 1000° C.) is between about 0 and $15\times10^{-7}$/°C./ The mold interior surface includes at least one projection extending towards the mold cavity. The projection is provided with a release (draft) angle of about 6°, tapering away from the base of the projection. Upon pouring, the molten metal surrounds at least a portion of the projection. Upon cooling within the mold, shrinkage of the metal casting against the tapered sides of the projection forces the casting along the projection, toward the latter's tapered end and away from the mold interior surface and thus partially out of the mold cavity. A method of making the ceramic mold of this invention is also disclosed.

10 Claims, 7 Drawing Sheets

REUSABLE CERAMIC MOLD

BACKGROUND OF THE INVENTION

The invention relates to a reusable ceramic mold for making foundry castings and more specifically to a ceramic mold having essentially no thermal expansion at the use temperature and which is so configured to prevent sticking or binding of the casting to the mold sections.

The most common foundry mold material for the mass production of articles is sand, compacted around a pattern supported within a mold flask. The pattern is withdrawn, leaving the impressed mold cavity. The sand is usually mixed with an oil or binder to cause the sand particles to cling together. Sand cores may be present within the mold cavity to form recesses in the metal casting. The ordinary sand mold is destroyed by the shakeout procedure required to release the casting.

This art is aware of reusable molds fashioned from a variety of materials, including ceramic and glass-ceramic materials, chosen for their refractory characteristics. Examples of such molds are seen in U.S. Pat. Nos. 4,411,305issued to Beetle, 4,244,551, issued to Terkelsen, and 4,236,568 issued to Larson.

While reusable ceramic and glass-ceramic molds represent a time and cost saving over sand molds, the casting is sometimes difficult to remove from the mold. If the casting has no recesses and is of a completely convex form in nearly all cross sections, i.e., a right circular cylinder or a sphere, then metal shrinkage upon cooling will not inhibit withdrawal from the mold sections. If, on the other hand, the casting has a recessed portion, formed by a projection or core integral with a mold section, the casting will often be difficult to separate from the mold section. This is caused by the greater shrinkage of the metal (3/32 inches per foot or 7.72 millimeters per meter) as compared to the shrinkage of the ceramic, with the somewhat shrunken casting binding on and thus sticking to the projections. In sand molds, metal shrinkage upon cooling does not pose a separation problem because the sand mold is broken apart to obtain the casting.

SUMMARY OF THE INVENTION

According to the practice of this invention, separation between the casting and mold sections (having cores or projections thereon) is facilitated by the provision of a taper or draft on the projections of at least 6 degrees. The direction of the taper is away from the base i.e., away from the mold surface from which the projection extends. The projections are integral with their respective mold sections. Upon pouring of the molten metal into the mold cavity, the latter formed from a plurality of mating mold sections, the metal surrounds a portion, if not all, of the projections, from the base of each projection toward its tip. Upon cooling and solidification of the metal, to thus form the casting, the shrinkage of the metal against the projection urges the casting along the projection, in a direction away from the mold section interior surface. This action thus facilitates separation of the casting from all of those mold sections provided with thus tapered projections.

In order for this action to occur to maximum effect, the projections, as well as the remaining mold parts, should undergo a minimum of expansion when contacted by the molten metal. While a variety of ceramic and glass-ceramic materials are available, one such material in particular has been found to consistently yield the described separation action. This material and its method of preparation is described in U.S. Pat. No. 3,600,204 issued to Beall et al, and may be generally characterized in the as finished article as consisting essentially of beta-spodumene and mullite crystallites.

Therefore, this invention pertains to a ceramic mold having a mold cavity for receiving molten metal and wherein the molten metal solidifies to near net shape of a cast article, which mold is made of a crystalline ceramic composition consisting essentially of crystals substantially all finer than 10 microns in diameter dispersed in a glassy matrix, wherein the crystals comprise at least 90% by weight of the composition and consist essentially of beta-spodumene solid solution and mullite with up to 15% by weight of the composition being mullite, and the composition consists essentially, by weight on the oxide basis, of about 3.5–7.5% $LiO_2$, 15–30% $Al_2O_3$, and 65–80% $SiO_2$, the mole ratio $Al_2O_3$:$LiO_2$ being between about 1.0–1.5 and the sum of $LiO_2$, $Al_2O_3$, and $SiO_2$ constituting at least 98% by weight of the total composition, and wherein the mold comprises a means to deliver molten metal to the ceramic mold cavity.

In a more particular embodiment, this invention pertains to a mold for making a metal casting, the mold having a plurality of mating sections to define a closed cavity within the mold, each mold section having a cavity-forming surface, the mold cavity, a sprue hole communicating between the mold cavity and the outside of the mold to thereby permit molten metal to be poured into the mold cavity, at least one mold section having a projection extending from a portion of its cavity-forming surface and towards the mold cavity, said projection having a draft angle of at least 6 degrees, at least one of said mold sections or said projection being formed of a crystalline ceramic composition having a coefficient of thermal expansion (0°–1000° C.) of about $0–15\times10^{-7}/°C.$, excellent dimensional stability at temperatures up to about 900° C. and consisting essentially of crystals substantially all finer than 10 microns in diameter dispersed in a glassy matrix, said crystals comprising at least 90% by weight of the composition and consisting essentially of beta-spodumene solid solution and mullite with up to 15% by weight of the composition being mullite and being formed through crystallization in situ from a glass frit consisting essentially, by weight on the oxide basis, of about 3.5–7.5% $Li_2O$, 15–30% $Al_2O_3$, and 65–80% $SiO_2$, the mole ratio $Al_2O_3$:$Li_2O$ being between about 1.0–1.5 and the sum of $Li_2O$, $A_2O_3$, and $SiO_2$ constituting at least 98% by weight of the total crystalline ceramic composition, whereby, upon solidifying and shrinking, the metal casting will move relative to, and along at least one projection and away from the cavity-forming surfaces of the mold section which carries said projection to thereby facilitate separation of the casting from the mold section.

Additionally disclosed herein is a method of making a reusable ceramic mold half, having a mold face, the method including the steps of making a master mold having a face of the same configuration as desired for the face of the reusable, ceramic mold half, pouring a slurry of plaster of Paris over the face of said master mold and allowing the plaster of Paris to harden, the hardened plaster of Paris defining a template mold having a mold face, removing the master mold from the template mold, forming a closed mold having said mold template face as a portion of its internal surface, pouring into said closed mold a slurry of said ceramic, allowing said ceramic slurry to harden at its exterior portions while still liquid at its interior portions, withdrawing the still liquid ceramic slurry from the interior of the partially formed ceramic mold, to thereby yield a reusable ceramic mold half having a substantially continuous cavity centrally thereof, the cavity inhibiting warping of the ceramic mold half during use.

The ceramic mold of this invention may be advantageously used in the mass production of articles, such as automotive engine parts, engine parts in general, such as in lawn mower engines, appliance parts, machine parts, and any moldable cast metal article, to near net shape in the casting of various metals and metal alloys. Stainless steels, ductile iron, aluminum, copper, nickel, titanium, tin, any moldable, ductile metal, and alloys thereof and therebetween may be cast from the molten metal state into a formed article. Importantly, the article may be released from the ceramic mold and the mold used for multiple castings on an assembly line basis without loss of the cast article dimensional integrity.

Additionally, innovation appertains to the means for delivering molten metal to the mold. In much of the prior art a system of runners and gating mechanisms are required to provide a means for entry into the casting mold. With the invention disclosed herein, a delivery means to deliver molten metal into the vertically held ceramic mold is disclosed thus dispensing with the need for prior art delivery systems. By delivering the molten metal in this manner a molten metal filter may be advantageously placed in the path of the molten metal thus insuring the delivery of a more pure liquid metal. Examples of delivery means are gravity and/or mechanized fed ladling, pouring from crucibles and/or other heat bearable containers. Thus delivered, the finished molded product is free of many of the defects common to the molding of articles in the prior art.

Those skilled in the metal casting art can appreciate the economies that can be realized from a near net shape reusable ceramic mold. Not only from the economy of scales realized from the reusable mold itself, but also from the savings in pollution control devices since organic binders will no longer be needed to hold the mold material together.

BRIEF DESCRIPTION OF THE DRAWINGS

FIG. 17 is a view of the set up slurry of FIG. 16 after it has been turned over and a cover cap put on.

DETAILED DESCRIPTION OF THE INVENTION

The particular description embodied herein is intended only as illustrative of the type of complex shapes that the inventive ceramic mold is capable of reproducing. Those skilled in this art can appreciate that if such a complex shape, such as a piston rod, can be reproduced with dimensional integrity that other shapes can as well be produced with a similar result. This will provide the before mentioned economies in these other shapes as well. Therefore the description, herebelow, is intended as illustrative of the sophistication inherent in this particular ceramic mold technology and is not intended to be limiting in scope.

Figure 1:
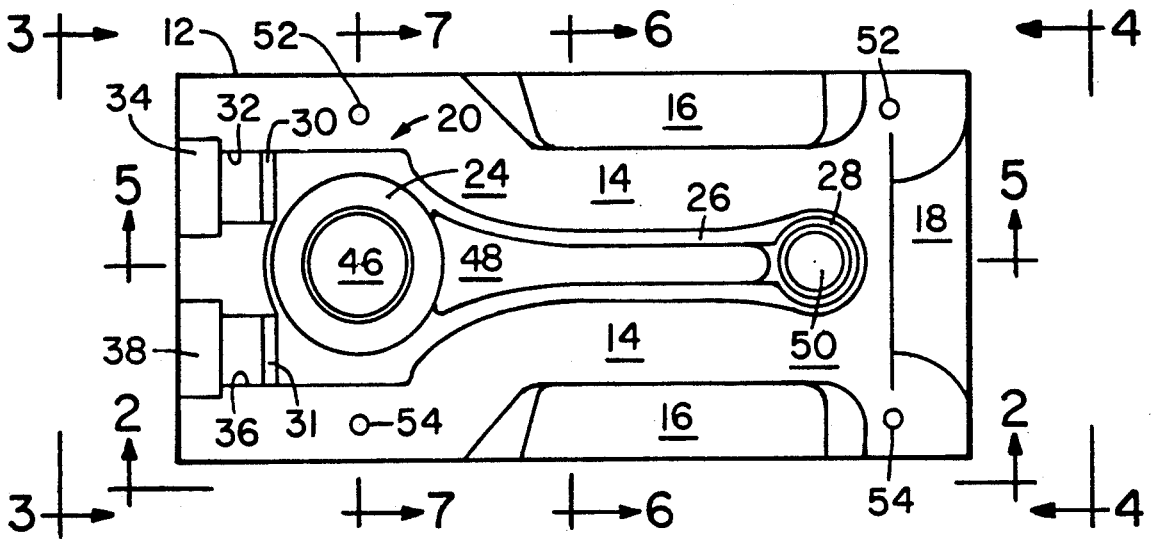
FIG. 1 is a plan view of a mold piece or section formed in accordance with this invention.
Figure 2:
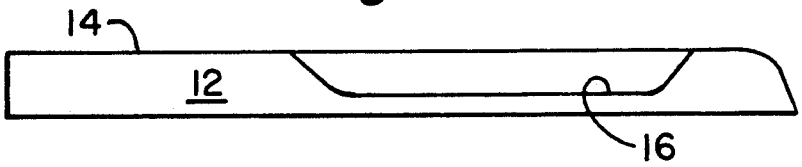
FIG. 2 is a side elevational view taken along 2—2 of FIG. 1.
Figure 3:
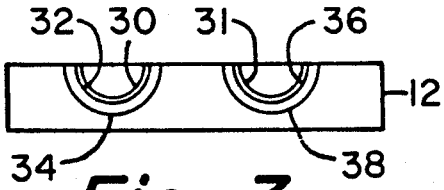
FIG. 3 is an end elevational view taken along 3—3 of FIG. 1.
Figure 4:
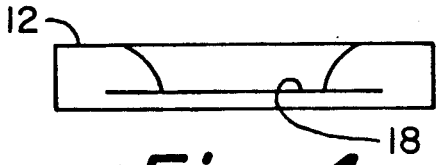
FIG. 4 is an end view taken along 4—4 of FIG. 1.

Referring now to FIGS. 1–7 of the drawings, the numeral 12 denotes generally a mold section formed in accordance with this invention. The upper surface 14 is smooth and is adapted to matingly abut a corresponding surface of a similar mold section to thereby define a complete cavity, as will later be explained. The numeral 16 denotes either of two recessed portions along the sides of the mold section and is shown at FIGS. 1 and 2 most clearly. The numeral 18 denotes a recess in one end of the mold section and is most clearly seen in FIGS. 1, 4 and 5. The numeral 20 denotes generally a mold cavity within section 12, the cavity including several portions or regions 24, 26 and 28. Portion 24 is adapted to form a first ring like member, portion 26 is adapted to form a middle or shank portion, while section 28 is adapted to form a second ring like member. The casting which is to be formed is that for a connecting rod for an internal combustion engine, although the invention is clearly not limited to this specific item of manufacture. The larger section 24 is to produce a ring, later to be split and reconnected by threaded elements and adapted to surround the crankshaft of an engine. The other ring portion 28 is adapted to receive a wrist pin carried by a piston.

Figure 5:
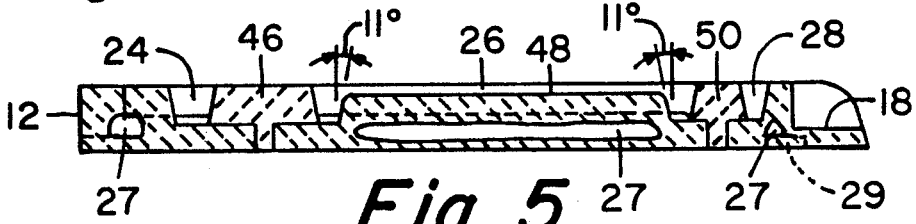
FIG. 5 is a cross-sectional view taken along 5—5 of FIG. 1.

A cavity 27, shown at FIG. 5, is located interiorly of mold 12. This cavity is formed during the manufacture of the mold, as will later be described. It has been determined that the inclusion of this cavity reduces bending or warping of the mold during its use.

The numeral 30 denotes a semicircular ridge of slightly less diameter than semicircular opening 32, the latter leading into semicircular opening 34. Counterpart elements 31, 36 and 38 correspond to elements 30, 32 and 34. These semicircular openings are most clearly shown at FIG. 3 of the drawings.

A first core or projection 46 is mounted by an internal pintle extending into a central aperture in portion 24 of the mold cavity. A second projecting portion is denoted by the numeral 48, the latter extending generally from portions 24 to 28 of the mold cavity. A third projection or core is denoted by the numeral 50 and, similarly, is mounted in the mold by means of an integral pintle extending into a complimentary recess in portion 28. It will be understood that projections or cores 46 and 50 may be integral with mold section 12, as is projection 48. Conversely, projection 48 may be removably mounted within the mold cavity by pin or other mounting elements.

Figure 6:
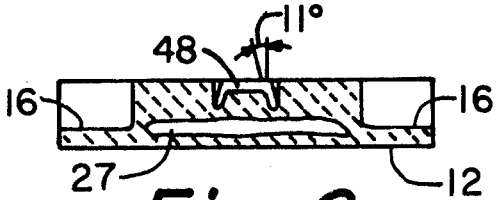
FIG. 6 is a transverse cross-section view taken along 6—6 of FIG. 1.
Figure 7:
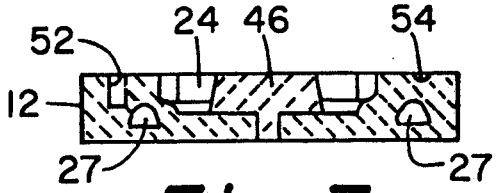
FIG. 7 is a transverse cross-sectional view taken along 7—7 of FIG. 1.

As illustrated at FIGS. 5 and 6, both the ends and the sides of projection 48 are provided with a draft or taper of at least 6 degrees, with 11 degrees being the preferred draft angle. Similarly, the sides of cores 46 and 50 are also be provided with a taper of the same value. Taper angles of less than 6 degrees will result in binding of the casting and thus cause difficulty in removing it.

Figure 12:
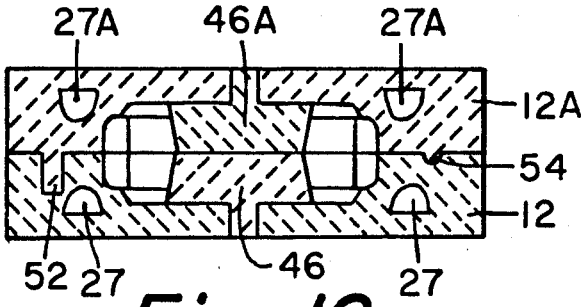
FIG. 12 is a view taken along section 12—12 of FIG. 8.

The lower mold half (shown in FIG. 1) is provided with a pair of recesses 54, while the upper half is provided with a pair of pin receiving openings 52. These depressions and openings are to receive complementary male portions on a second die half, as shown at FIG. 12, and now to be described.

Figure 8:
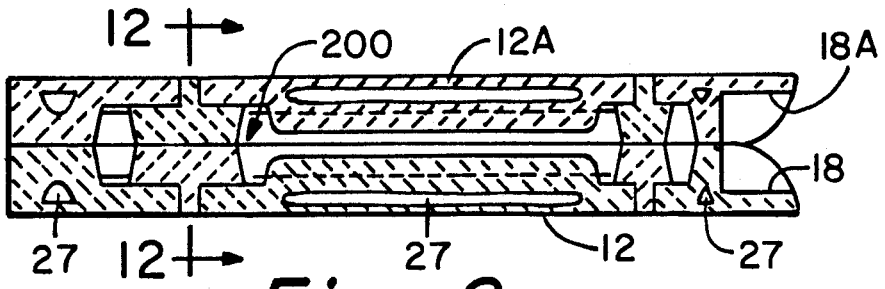
FIG. 8 is a cross-section of two of the mold sections of FIG. 1 and illustrates the formation of a closed mold cavity.

Referring now to FIG. 8 of the drawings, a second mold section denoted by 12A is shown as mating with section 12, these two sections being identical except for the aligning projections of one and the complementary recesses of the other. The postscript A denotes corresponding elements for mold Section 12A. The numeral 200 of FIG. 8 denotes the complete mold cavity defined by the mating of the two sections. It is seen from FIG. 10 that the cores 46 and 50, as well as the elongated projections 48 of the respective mold sections, are oppositely directed and are colinear.

Figure 9:
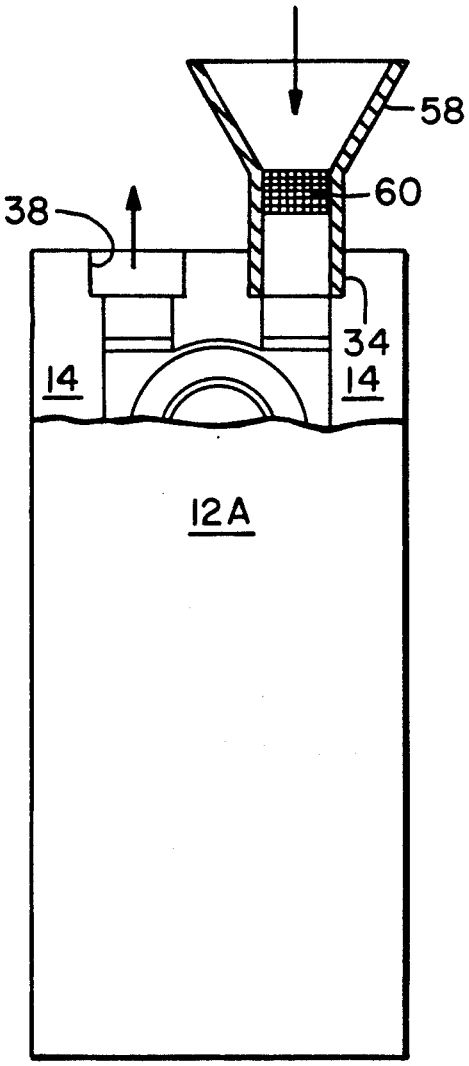
FIG. 9 is a view illustrating the pouring of molten metal into the mold of FIG. 8.

FIG. 9 illustrates the composite mold of FIG. 8 being vertically held and poured with a molten metal, such as iron, through a funnel 58 carrying a ceramic molten metal filter 60. The bottom of funnel 58 fits into the cylindrical opening (a sprue hole) defined by the two semicircular openings 34 of mold pieces or sections 12 and 12A. Similarly, a cylindrical air relief passage is defined by the mating halves of semicircular openings 38 in the two mold sections.

Figure 10:
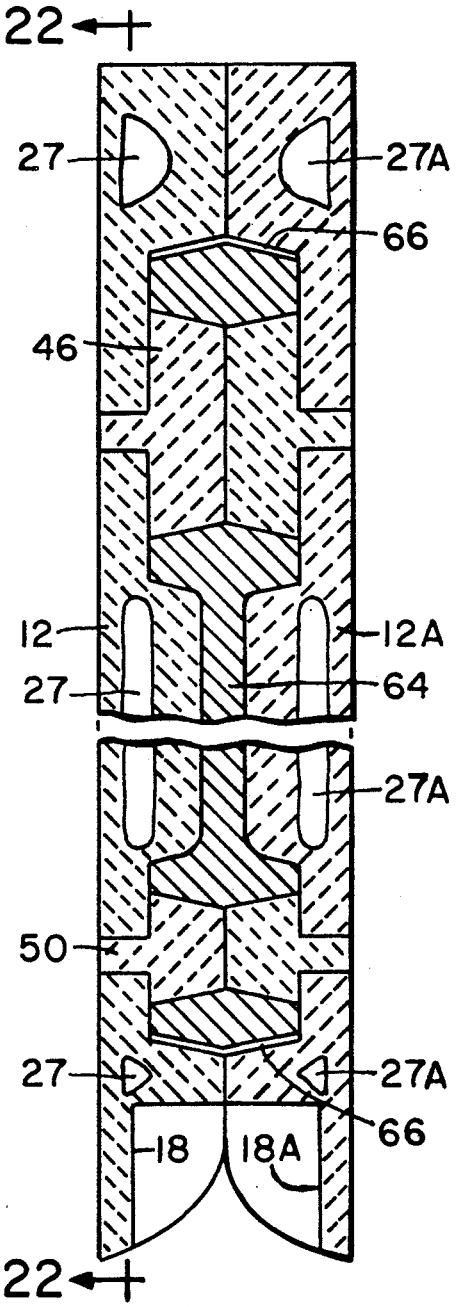
FIG. 10 is a view similar to FIG. 8 and illustrates the formation of a metal casting and attendant shrinkage of the metal.

FIG. 10 illustrates the mold interior after the metal has been poured and partially cooled so that its exterior regions are sufficiently rigid to permit removal of the casting from the mold (the interior of the casting still being in the molten state). The reader will observe that the casting 64, in the general form of a connecting rod, has been formed. Due to shrinkage of the metal there is a gap, indicated by the numeral 66, between the outermost periphery of the casting and the mold sections.

Figure 11:
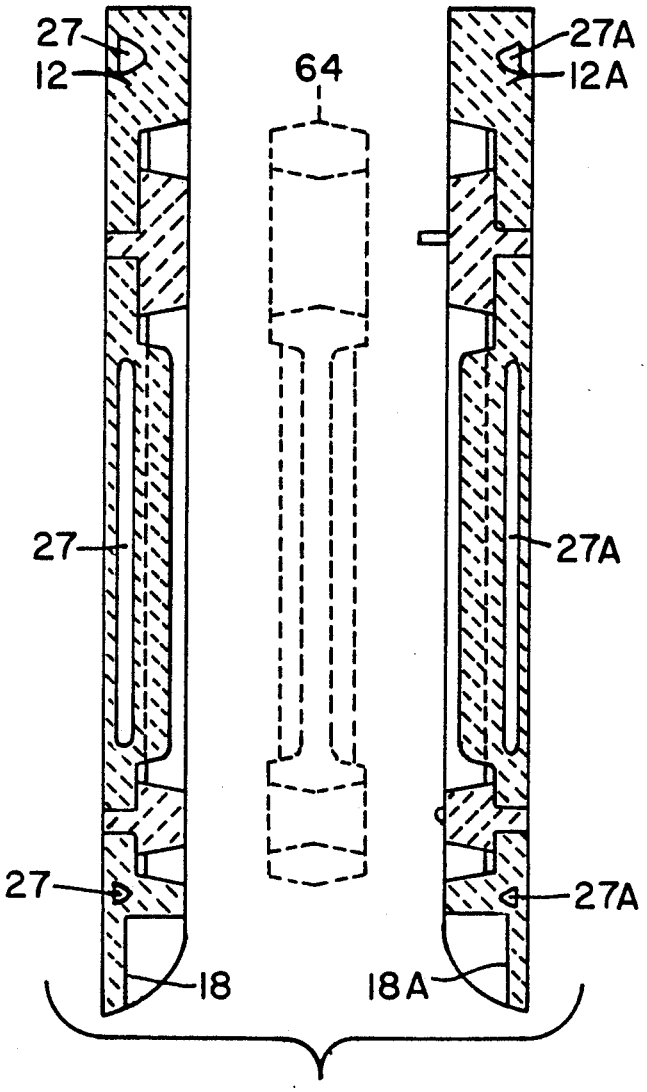
FIG. 11 is a view similar to FIG. 10, and showing the two mold sections separated to gain access to the workpiece or casting.

FIG. 11 illustrates the complete separation of the mold sections, with the casting 64 indicated by phantom lines. The indicated double taper in each end recess of the connecting rod casting is due to the draft taper of 11 degrees of the cores 46 and 50, with this taper later removed from the casting upon machining and finishing.

When the mold sections are separated, as by pushing apart sections 18 and 18A of the end of the mold or by separating opposite portions 16 of the mold sections, any tendency for the casting to stick or bind and thus remain in a respective mold section is overcome by the above described preferred taper of 11 degrees. Namely, upon shrinkage of the metal, the casting will tend to squeeze the sides and ends of projection 48 and the sides of cores 46 and 50 to thereby create a force urging the casting away from a respective mold section.

The following is a specific example of the invention.

Mold sections 12 and 12A were formed by casting them from the ceramic material described in the noted Beall patent, herein incorporated by reference. The mold sections were machined to provide each with smooth cavities and facing surfaces. A funnel with a ceramic molten metal filter was inserted into one of the openings at the end of the mating mold sections. Nodular iron cast within a temperature range of about 2200° to 2500° F., preferably about 2250° to 2350° F., was poured into the funnel until the mold was filled. After about 20 to 40 seconds, the mold sections were separated mechanically. The casting was x-rayed for defects and found to be satisfactory. The same mold sections were then used 20 times in the same manner without exhibiting signs of wear or degradation, and each casting thus formed was found to be satisfactory. The mold sections were each about 12 by 5 by ¾ inches (635 by 127 by 19 millimeters).

As a second example of the invention, the same procedure was followed, with the iron poured within the above preferred temperature range. The same testing techniques were employed and the mold sections were used 25 times without visual or microstructural signs of wear or degradation.

Figure 13:
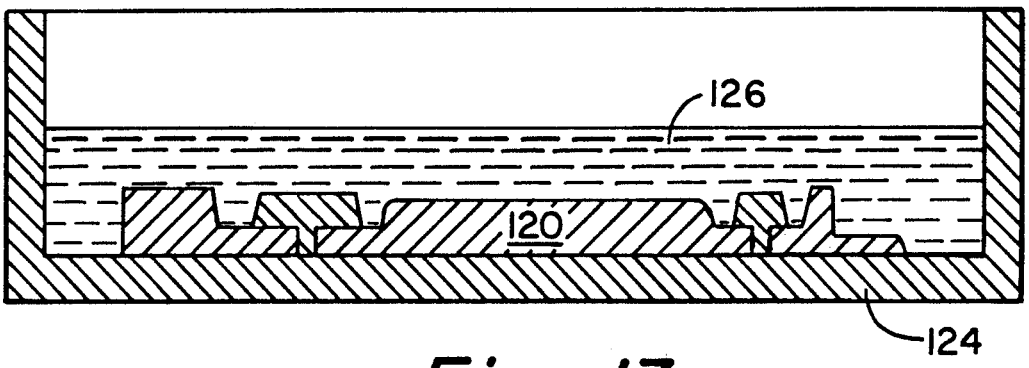
FIG. 13 is a cross sectional view, similar to FIG. 5, and shows a master mold 120 in a box and covered with a slurry.

Referring now to FIGS. 13–21, a description will now be given of the manner of formation of the reusable ceramic mold of this invention. Referring now to FIG. 13, a master mold of the same configuration as the mold 12 of FIG. 1 is designated as 120, and is shown as having been placed in a four sided open top box, such as a wooden box 124. The master mold or pattern may be formed of aluminum or other metal, or any of several materials known in this art. The master mold section shown is a mold half and has a face, the face being of the configuration of a portion of the article which is to be cast. A slurry 126, such as made from plaster of Paris (calcium sulfate)in this instance, however potter plaster or a similar material may be used, has been placed in the box and covers the master mold face, the opposite master mold surface lying on the box bottom.

Figure 14:
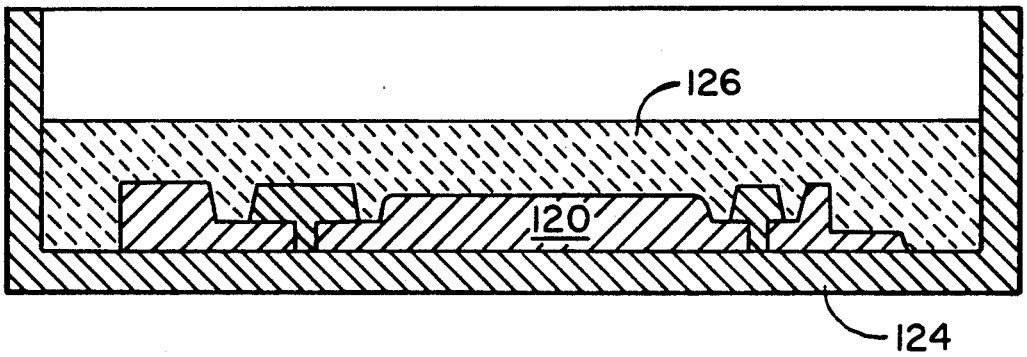
FIG. 14 is a view similar to FIG. 13, and shows the slurry after it has been set up.
Figure 15:
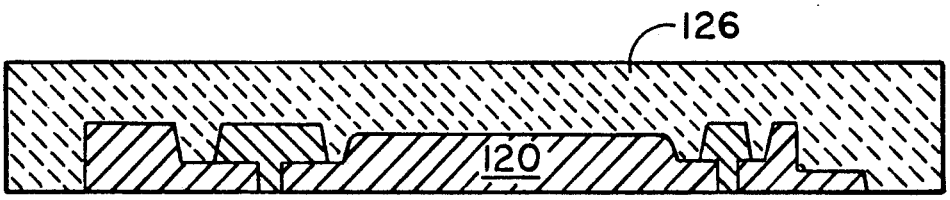
FIG. 15 is a view similar to FIG. 14, and shows the master mold with the set up slurry, the box having been removed.
Figure 16:
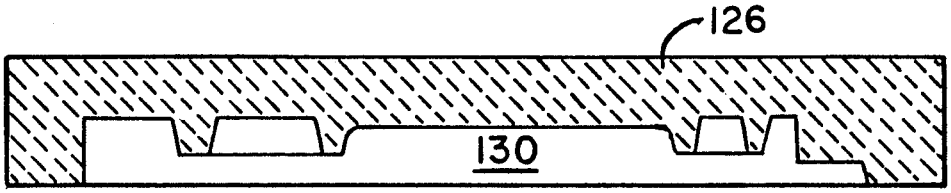
FIG. 16 is a view similar to FIG. 15, showing the set up slurry after the master mold has been removed.
Figure 17:
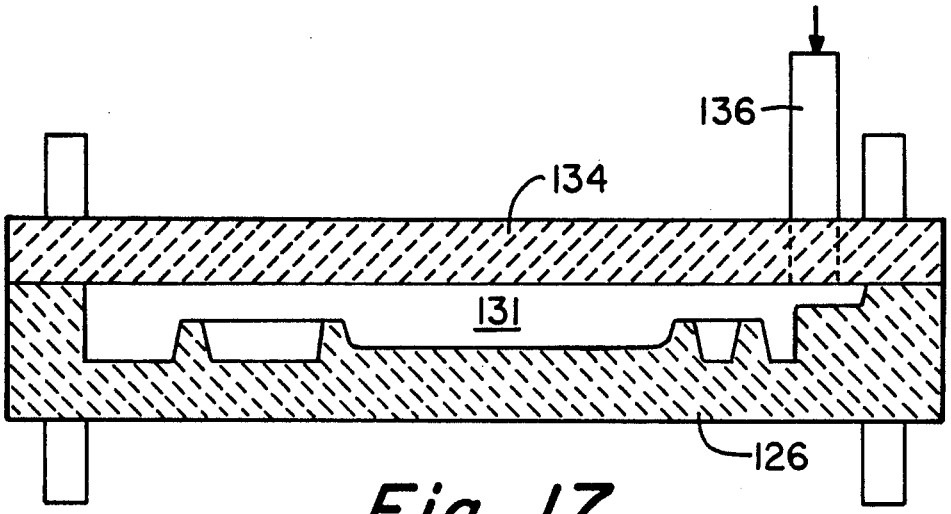
Figure 18:
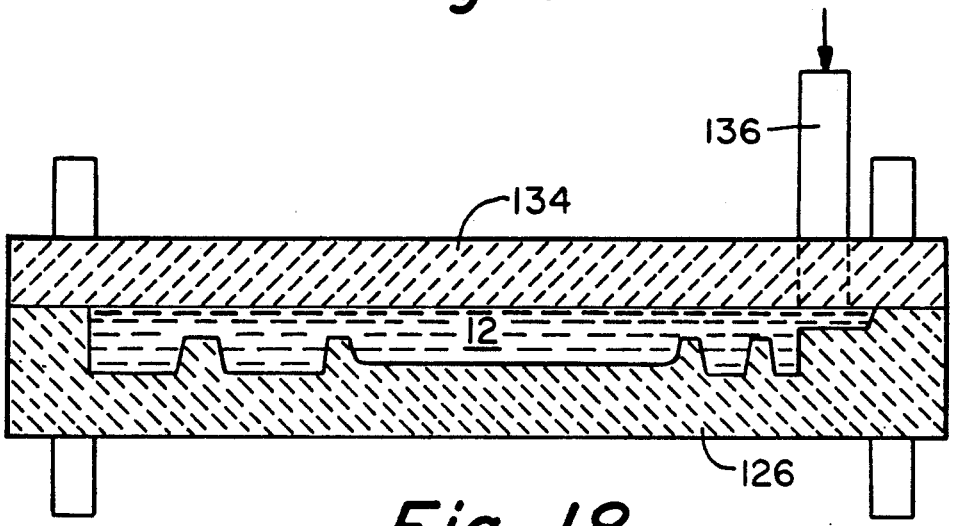
FIG. 18 is a view similar to FIG. 17 illustrating slurry as having been poured into a cavity between the cap and the original set up slurry.
Figure 19:
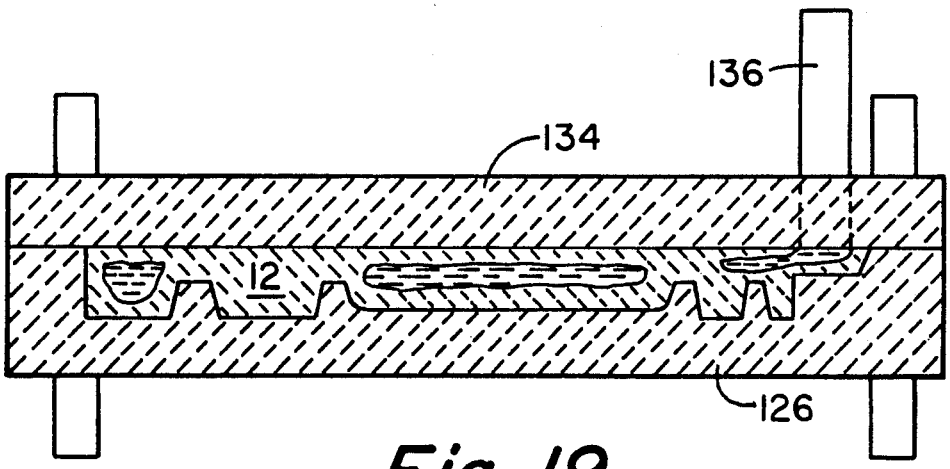
FIG. 19 is a view similar to FIG. 18 and illustrates the second slurry of FIG. 18 as now having been set up.

FIG. 14 illustrates the same assembly, except that the plaster slurry 126 has now been set up or hardened. After this hardening, the elements 120 and 126 are removed from the box, leaving what is shown at FIG. 15. The master mold 120 is now removed, as shown at FIG. 16, leaving an open cavity 130 (the mold face) on one surface of the now hardened plaster 126, the latter being termed an intermediate mold, or alternatively, a mold template. Referring now to FIG. 17, a flat cover cap 134 of a rigid material such as a plaster plate is placed over mold cavity 130 to thereby define a closed mold volume or cavity 131. This cavity communicates with the end of fill tube 136 and vent tube 138 (see FIG. 21). The vent tube 138, permits the escape of air from cavity 131 as the ceramic slip or slurry is poured into it. In FIG. 18, the ceramic slip is poured into cavity 131 through fill tube 136, with air within cavity 131 being exhausted through tube 138. At FIG. 19, the ceramic slip is shown as being partially hardened or set up in cavity 131. Namely, the outer or exterior portions of ceramic mold 120 have set up or hardened, while the central interior portion thereof is still liquid and hence flowable. This still not set up interior zone is denoted by the numeral 27, as also shown at FIG. 5.

Figure 20:
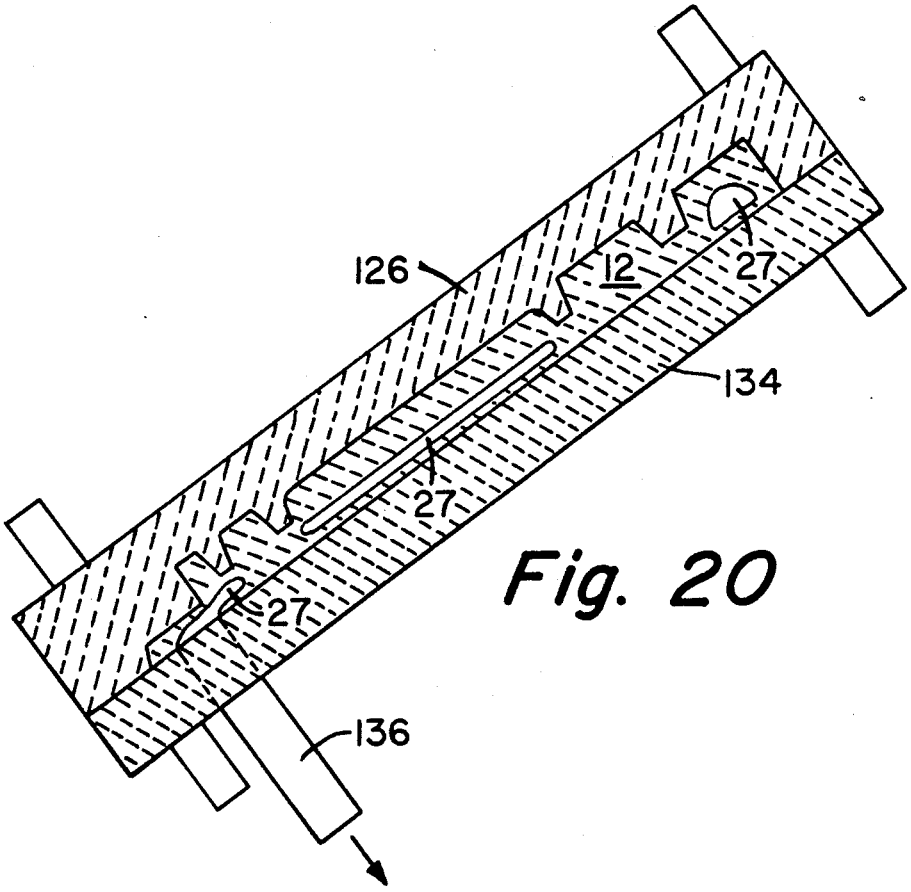
FIG. 20 is an end view of FIG. 19 showing fill and vent tubes.

As shown in FIG. 20, the mold is now tipped over to allow the liquid slip in zone 27 to flow out of either or both of tubes 136, 138. After final setting up of the ceramic slurry, the cover and mold portion 126 are removed and what is left is the mold 12 illustrated at FIG. 1 of the drawings.

Figure 21:
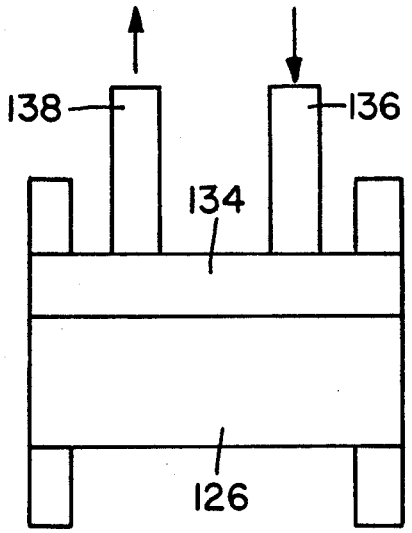
FIG. 21 is a view illustrating the mold as tipped over so that the second slurry can partially drain out and define the cavity.

FIG. 21 is an end view of the apparatus and illustrates the placement of the fill and exhaust tubes 136 and 138.

Figure 22:
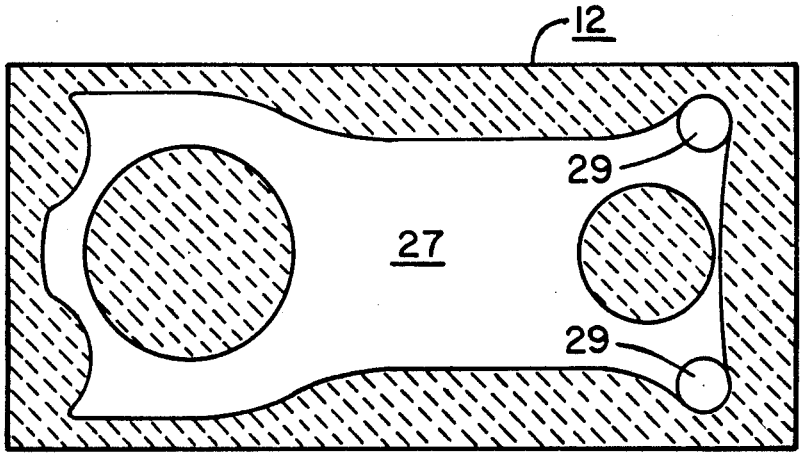
FIG. 22 is a sectional view taken along 22—22 of FIG. 10.

FIG. 22 illustrates the extent of cavity 27. The numerals 29 indicate the location of the ends of tubes 136 and 138 which extend into the mold.

We claim:

1. A mold for making a metal casting, the mold having a plurality of mating sections, each mold section having a cavity-forming surface, the cavity-forming surfaces defining a mold cavity, a sprue hole communicating between the mold cavity and the outside of the mold, at least one mold section having a projection extending from a portion of its cavity-forming surface and towards the mold cavity, said projection having a draft angle of at least 6 degrees as measured between said portion of the cavity-forming surface and the adjoining surface of said projection, at least one of said mold sections being formed of a crystalline ceramic composition having a coefficient of thermal expansion (0°-1000° C.) of about $0-15\times10^{-7}/°C.$, excellent dimensional stability at temperatures up to about 900° C. and consisting essentially of crystals substantially all finer than 10 microns in diameter dispersed in a glass matrix, said crystals comprising at least 90% by weight of the composition and consisting essentially of beta-spodumene solid solution and mullite with up to 15% by weight of the composition being mullite, and the composition being formed through crystallization in situ from a glass frit consisting essentially, by weight on the oxide basis, of about 3.5-7.5% $Li_2O$, 15-30% $Al_2O_3$, and 65-80 $SiO_2$, the mole ratio $Al_2O_3$: $Li_2O$ being between about 1.0-1.5and the sum of the total crystalline ceramic composition, whereby upon solidifying and shrinking, the metal casting will move relative to and along said projection and away from the cavity-forming surfaces of the mold section which carries said projection to thereby facilitate separation of the casting from the mold section.

2. The mold of claim 1 wherein there are at least two of said projections, each carried by a respective mold section, said projections being oppositely directed.

3. The mold of claim 1 wherein both mold sections are formed of said crystalline ceramic.

4. The mold of claim 1 wherein a molten metal filter is incorporated within said mold to filter the molten metal before said molten metal is molded.

5. The mold of claim 4 wherein said draft angle is 11 degrees.

6. The mold of claim 1 wherein the draft angle of said projection is at least 11°.

7. The ceramic mold of claim 1 wherein said cavity is formed in the shape of a piston rod.

8. The ceramic mold of claim 1 wherein said cavity is formed in the shape of an automotive engine part.

9. A mold for making a metal casting, the mold having a plurality of mating sections, each mold section having a cavity-forming surface, the cavity-forming surface defining a mold cavity, a sprue hole communicating between the mold cavity and the outside of the mold, at least one mold section having a projection extending from a portion of its cavity-forming surface and towards the mold cavity, said projection having a draft angle of at least 6 degrees as measured between said portion of the cavity-forming surface and the adjoining surface of said projection, said projection being formed of a crystalline ceramic composition having a coefficient of thermal expansion (0°-1000° C.) of about $0-15\times10^{-7}/°C.$, excellent dimensional stability at temperatures up to about 900° C. and consisting essentially of crystals substantially all finer then 10 microns in diameter dispersed in a glassy matrix, said crystals comprising at least 90% by weight of the projection and consisting essentially of beta-spodumene solid solution and mullite, and the composition being formed through crystallization in situ from a glass frit consisting essentially, by weight on the oxide basis, of about 3.5-7.5% $LiO_2O$, 15-30% $Al_2O_3$, and 65-80% $SiO_2$, the mole ratio $Al_2O_3$: $Li_2O$, being between about 1.0-1.5 and the sum of $Li_2O$, $Al_2O_3$ and $SiO_2$ constituting at least 98% by weight of the total crystalline ceramic composition, whereby, upon solidifying and shrinking, the metal casting will move relative to and along the projection and away from the cavity-forming surface of the mold section which carries said projection to thereby facilitate separation of the casting from the mold section.

10. A ceramic mold having a mold cavity for receiving molten metal and wherein the molten metal solidifies to near net shape of a cast article, which mold is made of a crystalline ceramic composition consisting essentially of crystals substantially finer than 10 microns in diameter dispersed in a glassy matrix, said crystals comprising at least 90% by weight of the composition and consisting essentially of beta-spodumene solid solution and mullite with up to 15% by weight of the composition being mullite, and the composition consists essentially, by weight on the oxide basis, of about 3.5-7.5% $Li_2O$, 15-30% $Al_2O_3$, and 65-80% $SiO_2$, the mole ratio $Al_2O_3$, and $SiO_2$ constituting at least 98% by weight of the total crystalline ceramic composition, and wherein said ceramic mold includes means to deliver molten metal to the ceramic mold cavity.

* * * * *

UNITED STATES PATENT AND TRADEMARK OFFICE

CERTIFICATE OF CORRECTION

PATENT NO. : 4,938,802

DATED : July 3, 1990

INVENTOR(S) : Dale A. Noll, John J. Scholl, Stephen G. Skellett, II

It is certified that error appears in the above-identified patent and that said Letters Patent is hereby corrected as shown below:

Column 2, line 29, after "the" should read -- cavity-forming surface defining a --.

Column 2, line 52, -- $A_2O_3$ -- should read -- $Al_2O_3$ --.

Column 2, line 55, omit -- , -- after "to".

Column 7, claim 1, line 48, -- glass -- should read -- glassy --.

Column 8, claim 9, line 39, -- $LiO_2O$ -- should read -- $Li_2O$ --.

UNITED STATES PATENT AND TRADEMARK OFFICE

CERTIFICATE OF CORRECTION

PATENT NO. : 4,938,802

DATED : July 3, 1990

INVENTOR(S) : Dale A. Noll, et al

It is certified that error appears in the above-identified patent and that said Letters Patent is hereby corrected as shown below:

Column 8, claim 10, line 60, after "$Al_2O_3$" should read -- :$Li_2O$ being between about 1.0-1.5 and the sum of $Li_2O$, $Al_2O_3$ --.

Signed and Sealed this

Tenth Day of November, 1992

*Attest:*

*Attesting Officer*

DOUGLAS B. COMER

*Acting Commissioner of Patents and Trademarks*